US005310309A

United States Patent [19]

Terasaki et al.

[11] Patent Number: 5,310,309

[45] Date of Patent: May 10, 1994

[54] CENTRIFUGAL COMPRESSOR

[75] Inventors: Masatoshi Terasaki, Tsuchiura; Koji Nakagawa, Matsudo, both of Japan

[73] Assignee: Hitachi, Ltd., Tokyo, Japan

[21] Appl. No.: 961,389

[22] Filed: Oct. 15, 1992

[30] Foreign Application Priority Data

Oct. 21, 1991 [JP] Japan ..... 3-272333

[51] Int. Cl.[5] ..... F04D 29/30

[52] U.S. Cl. ..... 415/208.3; 415/211.2

[58] Field of Search ..... 415/208.1, 208.2, 208.3, 415/211.2, 211.1, 914

[56] References Cited

U.S. PATENT DOCUMENTS

| | | | |
|---|---|---|---|
| 2,157,002 | 5/1939 | Moss . | |
| 3,644,055 | 2/1972 | Davis | 415/208.3 |
| 3,781,128 | 12/1973 | Bandukwalla | 415/208.3 |
| 4,349,314 | 9/1982 | Erwin | 415/208.3 |
| 4,354,802 | 10/1982 | Nishida et al. | 415/208.3 |
| 5,165,849 | 11/1992 | Nakagawa et al. | 415/208.1 |
| 5,178,516 | 1/1993 | Nakagawa et al. | 415/208.3 |

FOREIGN PATENT DOCUMENTS

| | | |
|---|---|---|
| 0040534 | 5/1981 | European Pat. Off. . |
| 1053714 | 10/1955 | Fed. Rep. of Germany . |
| 2187031 | 5/1972 | France . |

*Primary Examiner*—John T. Kwon

*Attorney, Agent, or Firm*—Antonelli, Terry, Stout & Kraus

[57] ABSTRACT

A centrifugal compressor has a diffuser with stator blades arranged therein for converting the kinetic energy of a fluid discharged from an impeller into a pressure energy. The stator blades have leading edges inclined in the downstream direction while extending away from a side plate toward a core plate. Auxiliary blades having a chord length shorter than that of each of the stator blades have leading edges inclined in the downstream direction while extending away from the side plate toward the core plate and are arranged at positions radially inward of the stator plates in such a manner that one of the surfaces of each of the auxiliary blades faces a stator blade. The compressor is capable of operating without suffering from surging and rotating stall even in a low flow rate region.

14 Claims, 6 Drawing Sheets

CENTRIFUGAL COMPRESSOR

BACKGROUND OF THE INVENTION

1. Field of the Invention

The present invention relates to a centrifugal compressor which is required to provide high efficiency and a wide operational range.

2. Description of the Prior Art

Some centrifugal compressors include a plurality of stator blades arranged at equal intervals about a circumference of the diffuser disposed around the impeller. The spaces between the stator blades and the space between the side walls of the diffuser cooperate to provide a diffuser passage. In an operational region where the rotational speed is high and the flow rate is low, a separation area is generated on the negative-pressure surfaces of the stator blades, thereby failing to achieve a sufficient increase in pressure. This first results in the so-called rotating stall, in which the separation area rotates in the circumferential direction. When the flow rate is further decreased, a surging phenomenon occurs. One form of the art for shifting the surging phenomenon to a low flow-rate side comprises a proposal of a centrifugal compressor in which auxiliary blades are arranged radially inwardly of the spaces between stator blades arranged at equal intervals on the diffuser and in which stator or auxiliary blades have leading edges inclined in the downstream direction while extending away from the side plate toward the core plate (e.g., Japanese Patent Unexamined Publication No. 1-247798).

However, such a centrifugal compressor, in which leading edges of stator or auxiliary blades are inclined in the downstream direction while extending away from the side plate toward the core plate, does not sufficiently prevent a surging phenomenon in a low flow rate region. Further, since the compressor has stator blades are arranged at equal intervals throughout the circumference of the diffuser disposed around the impeller, sufficient consideration has not been paid to the prevention of rotating stall.

SUMMARY OF THE INVENTION

An object of the present invention is to provide a centrifugal compressor capable of operating without being subjected to surging and rotating stall even in a low flow-rate region.

According to the present invention, there is provided a centrifugal compressor comprising a diffuser provided with stator blades operative to convert the kinetic energy of a fluid discharged from an impeller into a pressure energy, wherein stator blades have leading edges inclined in the downstream direction while extending away from a side plate toward a core plate; and auxiliary blades each having a chord length shorter than that of each stator blade have leading edges inclined in the downstream direction while extending away from the side plate toward the core plate, with the auxiliary blades being arranged at positions radially inward of the stator blades in such a manner that one of the surfaces of each auxiliary blade faces a stator blade.

The present invention also provides a centrifugal compressor comprising a diffuser provided with stator blades operative to convert the kinetic energy of a fluid discharged from an impeller into a pressure energy, wherein the stator blades are non-uniformly arranged in the diffuser and have leading edges inclined in the downstream direction while extending away from a side plate toward a core plate; and auxiliary blades each having a chord length shorter than that of each of the stator blades have leading edges inclined in the downstream direction while extending away from the side plate toward the core plate, with the auxiliary blades being arranged at positions radially inward of the stator blades in such a manner that one of the surfaces of each of the auxiliary blades faces a stator blade.

According to the present invention, both stator blades and auxiliary blades have leading edges adjacent the side plate which are disposed at positions closer to the impeller than corresponding positions in a conventional centrifugal compressor. As a result, streams flowing in directions approximating the tangential direction can be strongly led in the directions of the stator blades. This is effective to minimize or prevent the generation of counter current to thereby prevent surging even in the low flow rate region. Further, auxiliary blades are arranged together with stator blades at blade intervals varied to provide both a sparse area and a dense area so that the stator blades are non-uniformly arranged together with the auxiliary blades. As a result, a stall occurs first in certain part of the passage where the blade intervals create a sparse area than in other part of the passage with dense arrangement of blades. Thus, the rate of flow through the inter-blade passage where a stall has taken place decreases below the rate of flow through the inter-blade passage where a stall has not yet taken place to increase the rate of flow through the inter-blade passageway in the second part in the inter-blade passage where the stall has not yet taken place, to thereby minimize the occurrence of rotary stall.

DESCRIPTION OF THE PREFERRED EMBODIMENT

Figure 1:
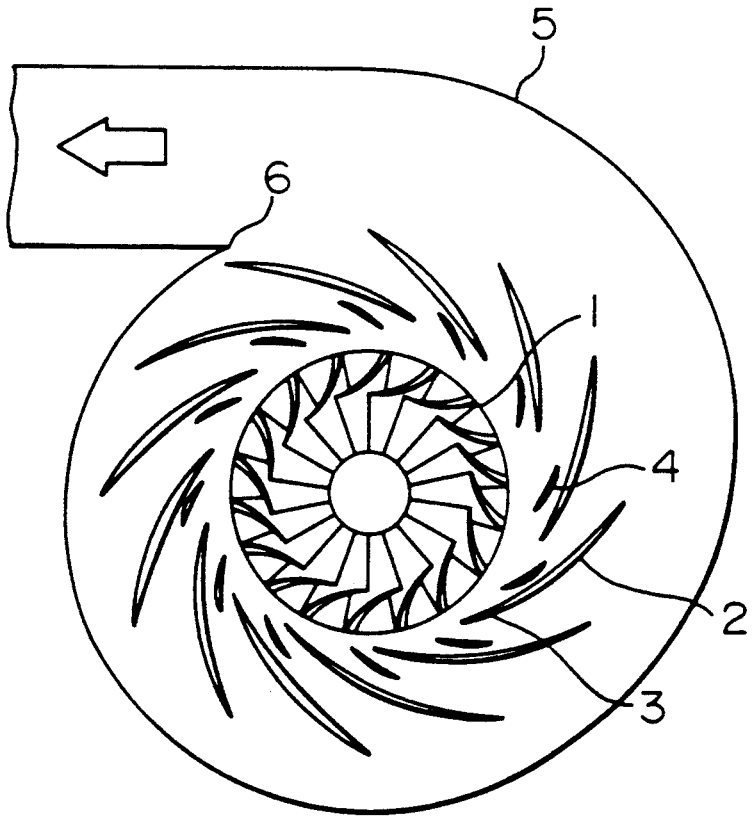
FIG. 1 is a schematic view of a first embodiment of a centrifugal compressor constructed in accordance with the present invention taken in the direction of the axis of rotation of the impeller.
Figure 2:
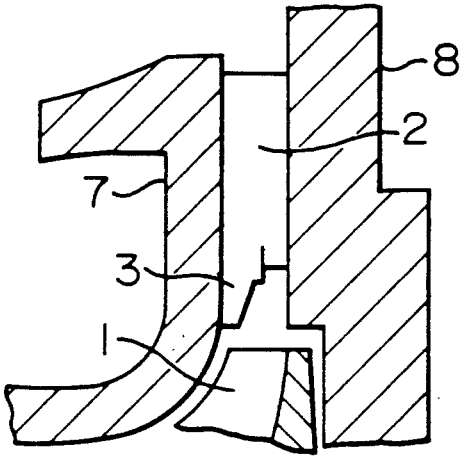
FIG. 2 is a partial longitudinal cross-sectional view of a diffuser portion of the centrifugal compressor of FIG. 1.
Figure 3:
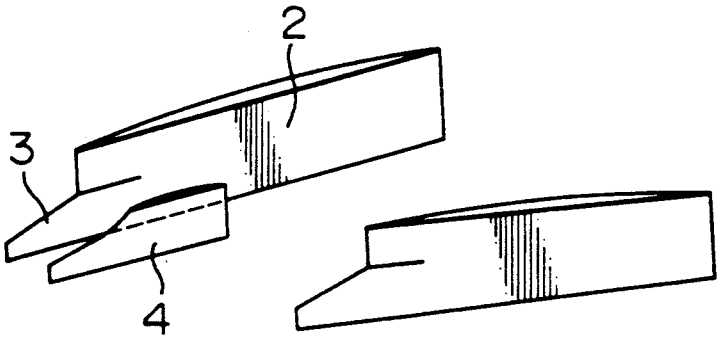
FIG. 3 is an exploded perspective view of an arrangement of a stator blade and an auxiliary blade in the centrifugal compressor of the present invention.

Referring to FIGS. 1-3, a space between an impeller 1 and a casing 5 defines the interior of a diffuser for converting the kinetic energy of a flow discharged from the impeller 1 into pressure. The diffuser is provided with a plurality of blades. Specifically, a stator blade 2 has a leading edge which is integral with a stator blade extension 3. The stator blade extension 3 has a height equal to or less than a height of the stator blade 2 and also has a leading edge inclined in the downstream direction while extending away from a side plate 7 toward a core plate 8. An auxiliary blade 4, having a chord length and a height less than a height of each stator blade 2, is disposed between an adjacent pair of stator blades 2 with only one of the surfaces of the auxiliary blade 4 facing one stator blade 2. Each auxiliary blade 4 has a leading edge inclined in the downstream direction while extending away from the side plate 7 toward the core plate 8. In a scroll-shaped flow passage (which may be a scroll having a helical flow-passage whose width gradually decreases, or collector having a constant-width helical flow-passage), the plurality of stator blades 2 and the plurality of auxiliary blades 4 are arranged in such a manner that the blades are arranged sparsely in the vicinity of a tongue portion 6 of the casing 5 (i.e., in an area approximately corresponding to not more than one half of the complete circumference) and that they are arranged densely in the area other than the vicinity of the tongue portion 6. In the case where the stator blades 2 are combined with auxiliary blades 4 disposed only in that part of the flow passage which is other than the part adjacent the tongue portion 6 (approximately corresponding to not more than one half of the complete circumference), the effect of preventing rotating stall is further increased.

In a condition where the operating flow rate of the compressor is high, a fluid discharged from the impeller 1 flows at an angle approximately equal to the entrance angle provided by the stator blades 2, the stator blade extensions 3 and the auxiliary blades 4. As a result, the kinetic energy of the flow is efficiently converted into pressure in passageways between the stator blades 2. In this process, since only one of the surfaces of each auxiliary blade 4 faces the corresponding stator blade 2, the width of the passageway between two adjacent pair of stator blades 2 is not reduced by the auxiliary blade 4, thereby assuring efficient conversion of the kinetic energy of the flow into pressure.

When the operational flow rate of the compressor has decreased, the fluid discharged from the impeller 1 does not flow at an angle approximately equal to the entrance angle provided by the blades 2, 3 and 4 but flows at an angle which deviates from the radial direction of the impeller 1. As a result, the flow has a strong tendency of not moving along the stator blades 2 having a strong action of converting the kinetic energy of the flow into pressure. This tendency is serious on the side of the side plate 7. If the flow does not move along the stator blades 2, a part of the flow forms a counter current, causing a stall, whereby the conversion of kinetic energy into pressure is made difficult. The stall may also cause the occurrence of abnormal phenomena such as rotating stall and surging, which would make the operation of the compressor difficult.

According to the present invention, the stator blade extensions 3 lead flow components at the leading edges of the stator blades 2 and adjacent the side of the side plate 7 toward the stator blades 2, while the auxiliary blades 4 lead the flow components in the intermediate portions of the stator blades 2 toward the stator blades 2. Thus, the stator blade extensions 3 and the auxiliary blades 4 cooperate with each other to strongly lead the flow. components adjacent the leading edges of the stator blades 2 toward the stator blades 2. In this manner, the occurrence of stall is restrained. Consequently, abnormal phenomena such as rotating stall and surging cannot easily take place. Therefore, it is possible to enlarge the operational range of the compressor in the flow-rate region.

In order to enlarge the operational range of the compressor in a lower flow-rate region, it is necessary to prevent rotating stall. Rotating stall is a phenomenon which takes place at a level of flow rate higher than the level involving surging. In a rotary phenomenon, a stall occurs at a part of the stator blades 2 and moves in the circumferential direction, generating great noise and vibration to make the operation of the compressor difficult. In a centrifugal compressor having a scroll-shaped flow passage, the pressure at the discharge port of the diffuser is not uniform in the circumferential direction when the flow rate is low. Specifically, the pressure is high in the vicinity of the tongue portion 6 and it is low at the opposing portion. Thus, the stator blades 2 in the vicinity of the tongue portion 6 have a higher risk of encountering a stall than the stator blades 2 in the opposing part. If the stator blade extensions 3 of the first-group of stator blades 2 adjacent the tongue portion 6 are removed, as in the embodiment shown in FIG. 1, the degree of the risk of the first group of stator blades 2 to encounter a stall is higher than that of the second group of stator blades 2 in the opposing part. With this construction, even when the first-group of stator blades 2 in the vicinity of the tongue portion 6 encounter a stall, the second-group stator blades 2 in the opposing part are free from a stall. As a result, the stall does not easily move in the circumferential direction, thereby restraining the occurrence of rotating stall. Even if a part of the stator blades 2 encounters a stall, the levels of noise and vibration generated do not substantially increase when there is no circumferential movement of the stall. Thus, the compressor is rendered operable at lower flow rate.

Figure 4:
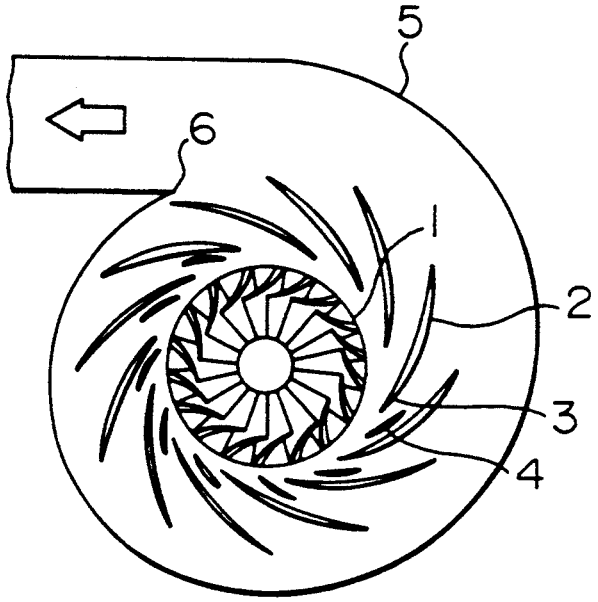
FIG. 4 is a schematic view of a second embodiment of a centrifugal compressor constructed in accordance with the present invention.
Figure 5:
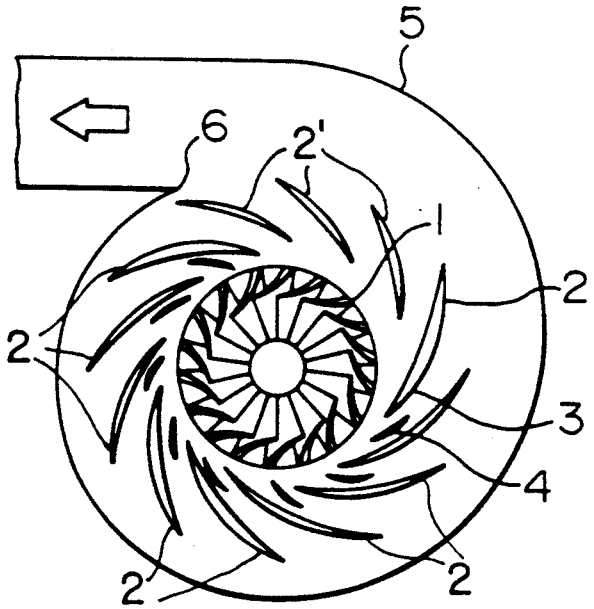
FIG. 5 is a sectional view of a third embodiment of a centrifugal compressor constructed in accordance with the present invention.
Figure 5A:
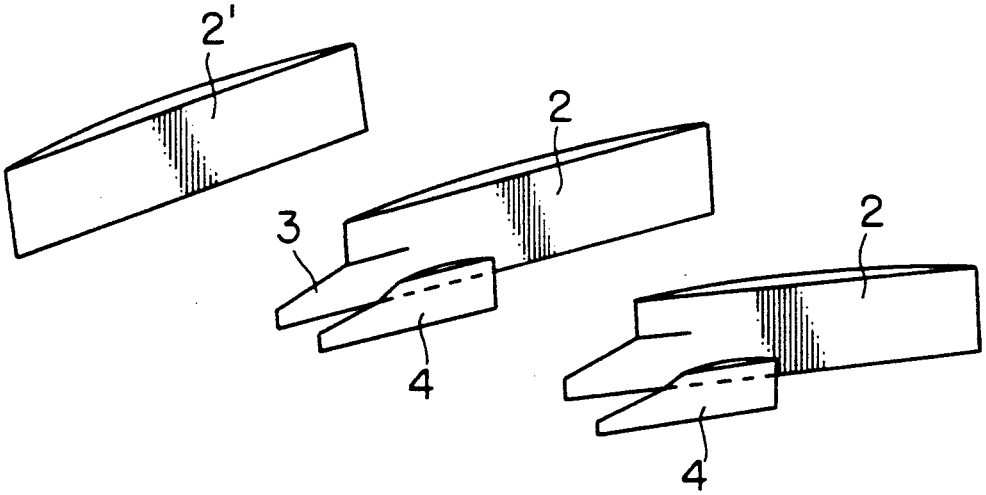
FIG. 5A is an exploded perspective view of an arrangement of a stator blade with inclined extensions at leading edges and another stator blade without an inclined extension.

In the embodiment of FIG. 4, a part of the auxiliary blades 4, arranged in facing relationship with some of the stator blades 2 in the vicinity of the tongue portion 6, is removed. In the embodiment of FIG. 5 a part of the stator blade extensions 3 as well as a part of the auxiliary blades 4 are removed. The stator blades which do not have extensions are designated by the reference numeral 2'. Thus, the leading edges of the stator blades 2' are not inclined in the downstream direction of the fluid flow. The embodiment of FIG. 5 provides a greater effect of preventing a rotary stall than the embodiments shown in FIGS. 1 and 4.

Figure 7:
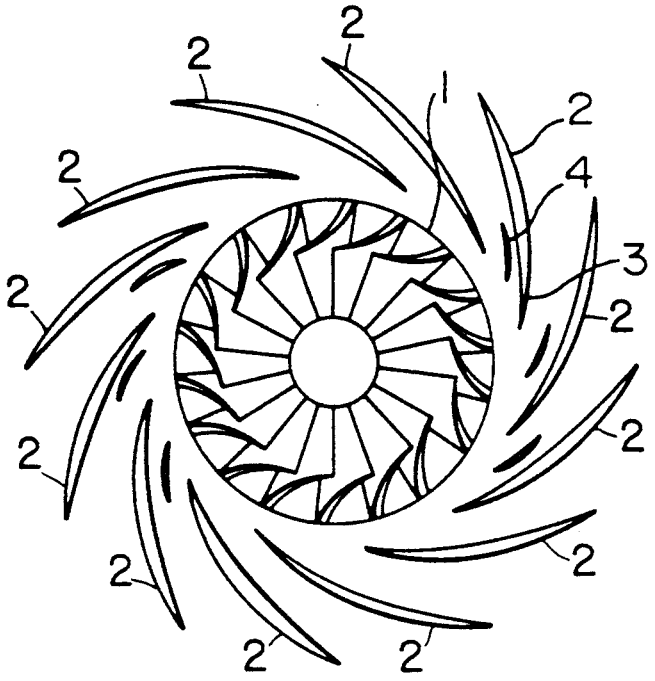
FIG. 7 is a schematic view of a fifth embodiment of a centrifugal compressor constructed in accordance with the present invention.
Figure 6:
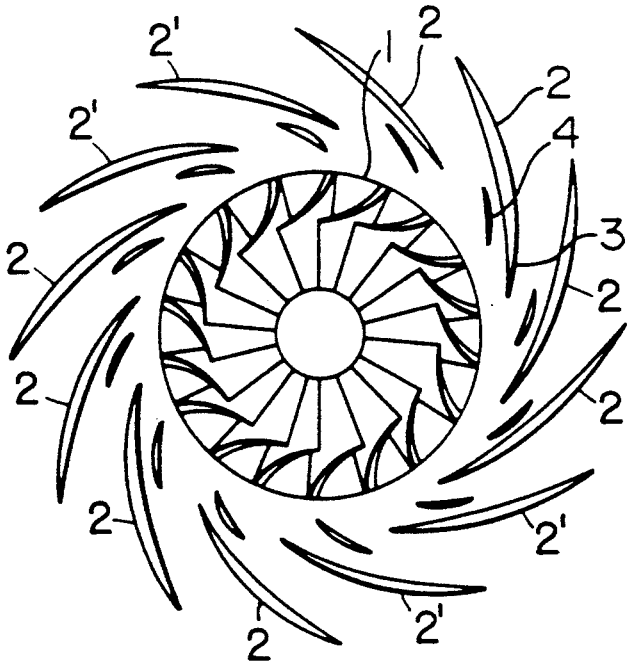
FIG. 6 is a schematic view of a fourth embodiment of a centrifugal compressor constructed in accordance with the present invention.
Figure 8:
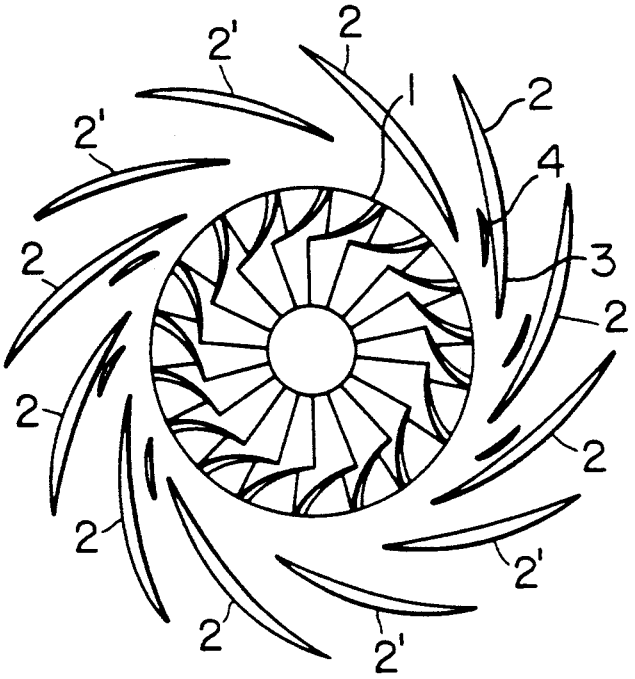
FIG. 8 is a schematic view of a sixth embodiment of a centrifugal compressor constructed in accordance with the present invention.

The embodiments of FIGS. 6 through 8 shows are suitable when the flow passage downstream of the diffuser is symmetric with respect to the axis. In the embodiment of FIG. 6, a part of the stator blade extensions 3 for the stator blades 2 is removed throughout the entire circumference. In the embodiment of FIG. 7, a part of the auxiliary blades 4 for the stator blades 2 is removed throughout the entire circumference. In the embodiment of FIG. 8, a part of the stator blade extension 3 and a part of the auxiliary blades 4 are both removed throughout the entire circumference.

Figure 9:
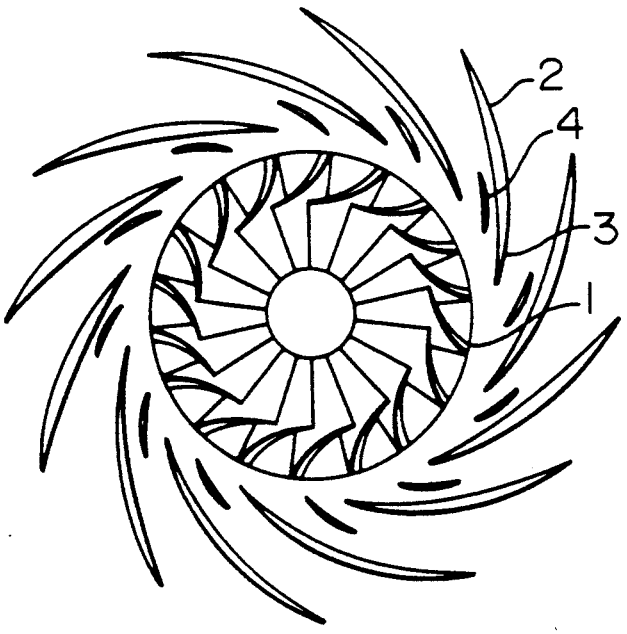
FIG. 9 is a schematic view of a seventh embodiment of a centrifugal compressor constructed in accordance with the present invention.

FIG. 9 shows an embodiment suitable for preventing surging as well as for reducing radial thrust while securing symmetry of the flow passage with respect to the axis. In this embodiment, all stator blades are of the first group designated by the reference numeral 2 and have inclined extensions.

What is claimed is:

1. A centrifugal compressor comprising a diffuser provided with stator blades operative to convert the kinetic energy of a fluid discharged from an impeller into a pressure energy, wherein said stator blades have leading edges inclined in the downstream direction while extending away from a side plate toward a core plate; and auxiliary blades each having a chord length shorter than that of each of said stator blades have leading edges inclined in the downstream direction while extending away from said side plate toward said core plate, said auxiliary blades being arranged at positions radially inward of said stator blades in such a manner that one of the surfaces of each said auxiliary blade faces a stator blade.

2. A centrifugal compressor according to claim 1, wherein the stator blades and said auxiliary blades are arranged in such a manner that the blades are sparse in a vicinity of a tongue portion of a scroll-shaped flow passage and dense in a part of said passage remote from said tongue portion.

3. A centrifugal compressor comprising a diffuser provided with stator blades operative to convert the kinetic energy of a fluid discharged from an impeller into a pressure energy, wherein said stator blades are uniformly arranged in said diffuser and have leading edges inclined in the downstream direction while extending away from a side plate toward a core plate; and auxiliary blades each having a chord length shorter than that of a chord length of each of said stator blades having leading edges inclined in the downstream direction while extending away from said side plate toward said core plate, said auxiliary blades being arranged at positions radially inwardly of said stator blades in such a manner that one of the surfaces of each of said auxiliary blades faces a stator blade.

4. A centrifugal compressor according to claim 3, wherein said stator blades and said auxiliary blades are arranged in such a manner that such blades are sparse in a vicinity of a tongue portion of a scroll-shaped flow passage and dense in a part of said passage remote from said tongue portion.

5. A centrifugal compressor comprising a diffuser provided with stator blades operative to convert he kinetic energy of a fluid discharged from an impeller into a pressure energy, wherein the stator blades are uniformly arranged in said diffuser, said stator blades including a first group of stator blades having leading edges inclined in a downstream direction while extending away from a side plate toward a core plate and a second group of stator blades having leading edges not inclined with respect to the downstream direction of the flow of said fluid, the stator blades of said first and second groups being arranged in a mixed number; and auxiliary blades each having a chord length shorter than that of a chord length of each of said stator blades have leading edges inclined in the downstream direction while extending away from said side plate toward said core plate are disposed radially inwardly of said stator blades in such a manner that one of the surfaces of each of said auxiliary blades faces a stator blade.

6. A centrifugal compressor according to claim 5, wherein said stator blades and said auxiliary blades are arranged in such a manner that such blades are sparse in a vicinity of a tongue portion of a scroll-shaped flow passage and dense in a part of said passage remote from said tongue portion.

7. A centrifugal compressor comprising a diffuser provided with stator blades operative to convert kinetic energy of a fluid discharged from an impeller into a pressure energy, wherein the stator blades are uniformly arranged in said diffuser, said stator blades having leading edges inclined in a downstream direction while extending away from a side plate toward a core plate; and auxiliary blades each having a chord length shorter than a chord length of each of said stator blades includes a first group of auxiliary blades having leading edges inclined in the downstream direction while extending away from said side plate toward said core plate and a second group of auxiliary blades having leading edges not inclined with respect to the downstream direction of the flow of said fluid, said first and second auxiliary blades being arranged in a mixed manner at positions radially inwardly of said stator blades in such a manner that one of the surfaces of each of said auxiliary blades faces a stator blade.

8. A centrifugal compressor comprising a diffuser provided with stator blades operative to convert kinetic energy of a fluid discharged from an impeller into a pressure energy, wherein the stator blades are uniformly arranged in said diffuser, said stator blades include a first group of stator blades having leading edges inclined in a downstream direction while extending away from a side plate toward a core plate and a second group of stator blades having leading edges not inclined with respect to the direction of the flow of said fluid, the stator blades of said first and second groups being arranged in a mixed manner; and auxiliary blades each having a chord length shorter than a chord length of each of said stator blades include a first group of auxiliary blades having leading edges inclined in the downstream direction while extending away from said side plate toward said core plate and a second group of auxiliary blades having leading edges not inclined with respect tot he direction of flow of said fluid, the auxiliary blades of said first and second groups being arranged in a mixed manner at positions radially inwardly of said stator blades in such a manner that one of the surfaces of each of said auxiliary blades faces a stator blade.

9. A centrifugal compressor comprising a diffuser provided with stator blades operative to convert kinetic energy of a fluid discharged from an impeller into a pressure energy, wherein the stator blades are non-uniformly arranged in said diffuser, and have leading edges inclined in a downstream direction while extending away from a side plate toward a core plate; and auxiliary blades each having a chord length shorter than a chord length of each of said stator blades and having leading edges inclined in the downstream direction while extending away from said side plate toward said core plate arranged at positions radially inwardly of said stator blades in such a manner that one of the surfaces of each of said auxiliary blades faces a stator blade.

10. A centrifugal compressor according to claim 9, wherein said stator blades and said auxiliary blades are arranged in such manner that said blades are sparse in the vicinity of a tongue portion of a scroll-shaped flow passage and dense in the part of said passage remote from said tongue portion.

11. A centrifugal compressor according to claim 10, wherein said vicinity of said tongue portion is an area including said tongue portion and corresponding to not more than one half of the entire circumference.

12. A centrifugal compressor comprising a diffuser provided with stator blades operative to convert kinetic energy of a fluid discharged from an impeller into a pressure energy, wherein the stator blades are non-uniformly arranged in said diffuser, and include a first group of stator blades having leading edges inclined in a downstream direction while extending away from a side plate toward a core plate and a second group of stator blades having leading edges normal to a direction of a flow of said fluid, the stator blades of said first and second groups being arranged in a mixed manner; and auxiliary blades each having a chord length shorter than a chord length of each of said stator blades and a leading edges inclined in the downstream direction while extending away from said side plate toward said core plate are arranged at positions radially inwardly of said stator blades in such a manner that one of the surfaces of each of said auxiliary blades faces a stator blade.

13. A centrifugal compressor comprising a diffuser provided with stator blades operative to convert kinetic energy of a fluid discharged from an impeller into a pressure energy, wherein the stator blades are non-uniformly arranged in said diffuser, said stator blades including a first group of stator blades having leading edges inclined in a downstream direction while extending away from a side plate toward a core plate and a second group of stator blades having leading edges normal to a direction of flow of said fluid, the stator blades of said first and second groups being arranged in a mixed manner; and auxiliary blades each having a chord length shorter than a chord length of each of said stator blades include a first group of auxiliary blades having leading edges inclined in the downstream direction while extending away from said side plate toward said core plate and a second group of auxiliary blades having leading edges normal to the direction of flow of said fluid, the auxiliary blades of said first and second groups being arranged at positions radially inwardly of said stator blades in such a manner that one of the surfaces of each of said auxiliary blades faces said stator blade.

14. A centrifugal compressor comprising a diffuser provided with stator blades operative to convert kinetic energy of a fluid discharged from an impeller into a pressure energy, wherein the stator blades are non-uniformly arranged in said diffuser, and include first group of stator blades having leading edges inclined in a downstream direction while extending away from a side plate toward a core plate and a second group of stator blades having leading edges not inclined with respect to the direction of flow of said fluid, said first and second groups of stator blades being arranged in a mixed manner; and auxiliary blades each having a chord length shorter than a chord length of each of said stator blades include a first group of auxiliary blades having leading edges inclined in the downstream direction while extending away from said side plate toward said core plate and a second group of auxiliary blades having leading edges not inclined to the direction of flow of said fluid, the auxiliary blades of said first and second groups being arranged in a mixed manner at positions radially inwardly of said stator blades in such a manner that one of the surfaces of each of said auxiliary blades faces a stator blade.

* * * * *